United States Patent [19]

Eitzinger et al.

[11] Patent Number: 5,070,599

[45] Date of Patent: Dec. 10, 1991

[54] AUTOMATIC FLIP-TOP CAP CLOSING AND TESTING MACHINE

[75] Inventors: Robert Eitzinger, Long Grove; John Mueller, Roselle,, both of Ill.

[73] Assignee: Mid-West Automation Systems, Inc., Buffalo Grove, Ill.

[21] Appl. No.: 584,768

[22] Filed: Sep. 19, 1990

Related U.S. Application Data

[63] Continuation-in-part of Ser. No. 337,273, Apr. 13, 1989, abandoned, which is a continuation-in-part of Ser. No. 251,193, Sep. 29, 1988, Pat. No. 4,847,988.

[51] Int. Cl.[5] ..... B23P 21/00

[52] U.S. Cl. ..... 29/705; 29/773; 29/822

[58] Field of Search ..... 209/552, 599; 269/47, 269/48.1, 52; 29/705, 710, 717, 718, 773, 783, 785, 786, 789, 790, 792, 793, 796, 797, 821, 822, 823

[56] References Cited

U.S. PATENT DOCUMENTS

| | | | |
|---|---|---|---|
| 415,544 | 11/1889 | Long et al. | 269/48.1 X |
| 3,255,519 | 6/1966 | Zabroski et al. | 29/823 |
| 4,511,044 | 4/1985 | Connor et al. | 209/522 |
| 4,523,377 | 6/1985 | Spletzer et al. | 29/773 |
| 4,811,850 | 3/1989 | Bankuty et al. | 209/597 X |
| 4,847,988 | 7/1989 | Eitzinger | 29/710 |

OTHER PUBLICATIONS

Sequist Closures Order No. 2243 (3 pages) and photographs (Originals filed with Ser. No. 07/337,273). Attached are photocopies of PTO Form 892 taken from Parent Application Ser. No. 07,251,193.

*Primary Examiner*—Joseph M. Gorski

*Attorney, Agent, or Firm*—Laff, Whitesel, Conte & Saret

[57] ABSTRACT

A machine automatically closes flip-top caps and tests their covers for proper opening and closing force. The machine has a pair of superimposed turntables separated by a wheel, the turntables and wheel turning as a unit about a common axis. The wheel has a plurality or pockets distributed around the periphery thereof to receive the open flip-flop caps after they are molded. The pockets are adjustable in size to accomodate caps of different diameters and heights. Cap gripping assemblies associated with each pocket firmly grip the cap to resist integral and vertical displacement of the cap. At least one and, in a preferred embodiment, both of the turntables have actuators positioned near each pocket on the wheel. Cams surround the turntables to raise and lower the actuators at selected locations. As the actuators raise and lower, the covers are flipped over to close the caps. Selected forces are applied through the actuators and corresponding cap opening fingers to reopen and reclose the covers. Covers which fail the force tests are separated from caps which pass the force tests.

4 Claims, 9 Drawing Sheets

AUTOMATIC FLIP-TOP CAP CLOSING AND TESTING MACHINE

This is a continuation-in-part application to Ser. No. 07/337,273 now abandoned, which is a continuation-in-part application to Serial No. 07/251,193, now U.S. Pat. No. 4,847,988.

BACKGROUND

This invention relates to automatic cap closing machines, and more particularly to machines for closing flip-top caps, which machines are easily adjustable to accommodate different size caps and test the cap covers after they are closed to insure that they can be reopened and closed with the proper amount of force.

Recent advances in packaging have introduced "flip-top" caps which may be used on toothpaste tubes, shampoo bottles, and similar devices. A flip-top cap is a unitary plastic part which has a hollow barrel part which may be fastened to the top of a toothpaste tube, for example. The top of the barrel has a cover hinged thereto in order to flip between two positions to open and close the top of the barrel.

The flip-top cap has to be an extremely low cost item owing to the high volume often required by industry. Also, many of the products sold in the packaging with flip-top caps are of relatively low cost, so that even a small fraction of a cent of excess cost for the cap might raise the retail price of the product sufficiently high to destroy the market for the product.

Usually, the flip-top caps are molded in a relatively large mold having in the order of forty to fifty or more cavities. The geometry of the mold cavities produce flip-top caps with the cover in a fully open position. Before the cap may secure the product in the tube, the cover must be flipped over the barrel to the closed position. This should be done to multiple caps simultaneously, rather than to each cap sequentially, to save time and avoid increasing the cost of the cap. Heretofore, cap closing has been accomplished primarily by the combination of an action mold for mechanically pushing the cover up from the mold, an air blast for moving the cover up from the mold, an air blast for moving the cover most of the way toward the closed position, and a final mechanical device for fully closing the cove. However, action molds are expensive and air blasts cool the mold and flip-tops, thereby increasing the chance that the hinge of the flip-top will crack or break during the closing process.

Frequently with the prior devices, the caps are not fully closed, so they reopen seconds later. Detection of incompletely closed caps usually depends on visual inspection. Also, since the closing process occurs while the caps are still in the mold, the mold cycle time is increased, thereby tying up the mold to reduce the output per cavity and make the entire process more costly.

One solution to these problems has been provided in Applicant's U.S. Pat. No. 4,847,988. With the invention disclosed there, numerous caps can be quickly and efficiently closed in a low-cost manner.

Yet even when all of the caps are closed, quality control problems derived from the initial molding process may remain. The cap covers are locked in place due to a friction fit between the cover and the barrel, and sometimes with a plastic flange on either the cover or barrel that engages or snaps into a depression on the other part of the cap. If molding results in caps which require too much force to reopen, the ultimate consumer is inconvenienced and displeased, and sales usually decrease. If molding results in covers which are locked too loosely, the cover may open prematurely during product assembly, shipment or during use by the consumer, resulting in jams in the capping equipment during bottle filling or spillage during shipment or consumer use. In each case, the manufacturer is faced with product returns, financial losses, and potential loss of consumer goodwill.

To combat these problems, present technology requires quality control personnel to periodically spot check small samples of production runs of caps. Usually, it is too expensive to check each cap. Therefore, overall cap quality is judged based on statistical assumptions rather than on the testing of each cap.

Additional problems and costs occur when it becomes necessary to close caps of a different size. For example, a large shampoo bottle will generally use a cap having a larger diameter and height than a small shampoo bottle. Product manufacturers which package their products using flip-top caps also frequently change the configuration of their caps, for either functional or marketing purposes. With cap-closing machines like the one described in U.S. Pat. No. 4,847,988 and most other machines, this means that either an entirely different cap closing machine must be used or a substantial number of different size components must be substituted in the cap closing machine to accommodate the different size caps. In particular, the component which receives the open cap must be changed to either a wider or more narrow opening, and the floor upon which the open cap sits during the cap closing process must be raised or lowered, to handle the new size caps. This changeover of parts results in substantial down time for the cap closing machine, higher costs for the various size machine components which must be stocked, purchases of several different size cap closing machines, and ultimately, higher manufacturing costs which are reflected in higher costs to the consumer.

One existing machine uses an adjustable ring-shaped track and dial pockets to accommodate a range of different size caps. However, the track must be manually set in the proper position for each different size cap, and the caps are retained in the dial pockets merely with an L-shaped stop and a small hold-down slide, both of which loosely confine the cap barrel between them. This device may keep the caps from moving laterally, but the caps are not clamped or firmly held down in the pocket, which precludes testing the covers for proper opening and closing forces while the caps are in the dial pockets.

Accordingly, it is an object of this invention to reduce the engineering and manufacturing costs involved in operating a cap closing machine. Yet another object is to provide a cap closing machine capable of easily adjusting to a range of different size caps without component changes and without an entire change of machine.

A further object is to provide an effective and efficient means for testing flip-top caps to determine whether their covers open and close with the proper amount of force, and to avoid the need for costly and often ineffective spot-checking of caps.

SUMMARY OF THE INVENTION

In keeping with an aspect of the invention, these and other objects are accomplished by a cap closing machine having a wheel-shaped transport that is loaded from a cap orienting feeder. The wheel moves the flip-top caps around a predetermined path. During its travel along the path of the wheel, each cap is retained within an opening or pocket in the wheel, the size of the pocket being adjustable depending on the positions of a pair of coaxial dials, which together form the wheel. A cap gripping assembly associated with each wheel pocket firmly grips the cap in the pocket, to restrain the cap not only from lateral movement within the pocket, but also to hold it down during the cover opening process. The wheel accommodates caps of different heights. The cap gripping assembly is cam controlled and opens as the wheel receives open caps, closes and secures the caps once the caps are received and while the covers are closed, and opens again to reject improperly closed caps or to eject the properly closed caps. Improperly closed caps are separated from properly closed caps.

While traveling around the path, a first actuator moves the cover of the cap to an over-center position. Then, one of several different closing mechanisms can be used to close the caps. For example, a second actuator can be used to close the cover as described in U.S. Pat. No. 4,847,988. With this mechanism, the invention can be used to test the cap covers. The cover may be closed over the barrel with a variable but predetermined maximum amount of closing force. A sensor may confirm that the closure is completed. A cap opener finger having a hooked end applies a variable but predetermined maximum amount of opening force to reopen the cap cover, which determines whether the proper amount of force will open the cap. A sensor again checks the cap to determine if the cap has opened. Once reopened, the second actuator closes the cap again. The cap opener finger then applies less than the desired minimum amount of opening force, and a sensor checks if the cover has improperly opened. Caps failing one or more of the force tests are rejected.

Yet another mechanism for closing the caps employs a rolling wheel biased with a prescribed force against the cap covers as the wheel passes the mostly closed caps beneath the wheel.

BRIEF DESCRIPTION OF THE DRAWINGS

The preferred embodiments of the invention are shown in the drawing wherein.

DETAILED DESCRIPTION OF THE INVENTION

Figure 2:
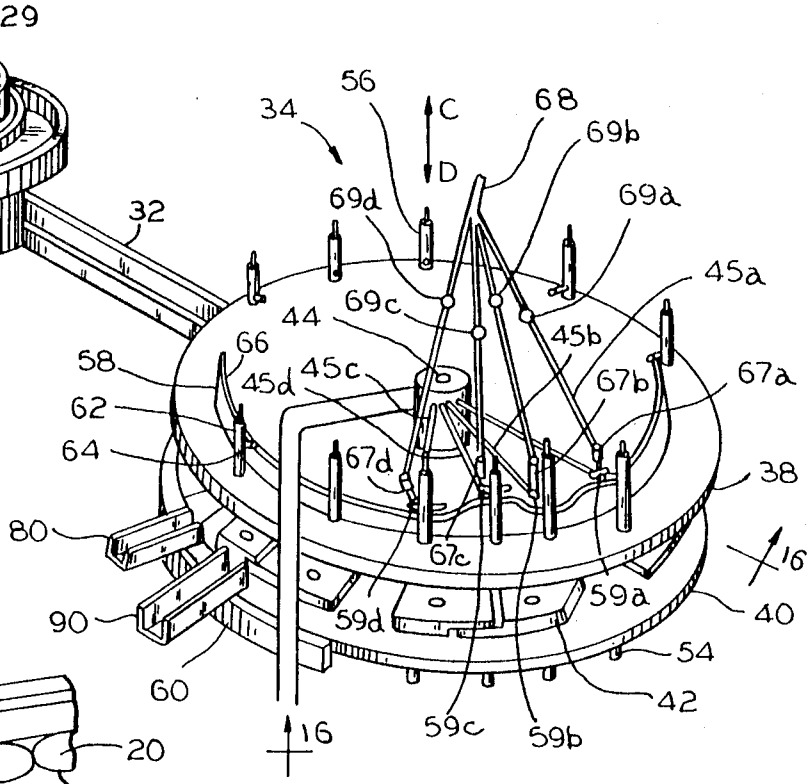
FIG. 2 is a perspective view of the invention showing a first embodiment of a cap closing mechanism.

A flip-top cap 20 (FIG. 1) is usually molded in a cavity which causes the top or cover 22 to extend out to the side and near the top of a hollow barrel 24, the cover being joined to the barrel by a hinge 26. This device 20 is a single, unitary part which is usually formed in a large mold, having perhaps forty to fifty cavities.

After the cap is molded, the cover 22 must be rotated in direction A on the hinge 26 to an over-center, pre-closed position so that when pushed down (direction B), it will snap shut over the top of barrel 24. Once the flip-top cover is finally and completely shut over the top of barrel 24, it may be handled by automatic machines in the same manner that traditional bottle tube caps are handled, if there is no flip-top.

Figure 1:
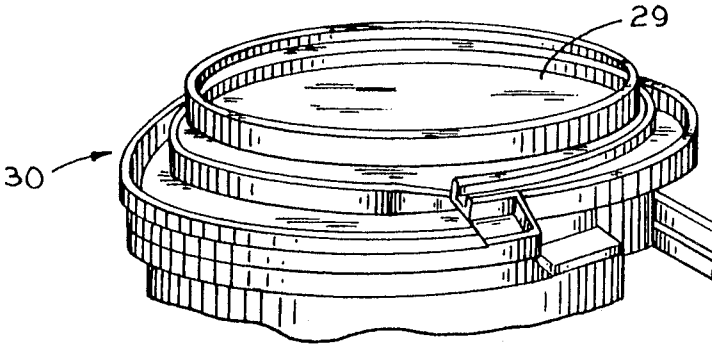
FIG. 1 is a perspective view of a flip-top cap typical of the type used with the invention.
Figure 1:
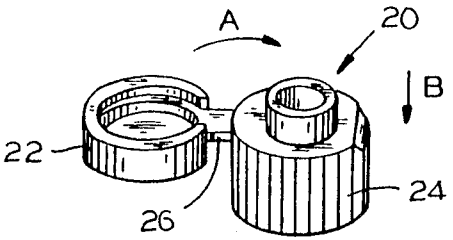
Figure 3:
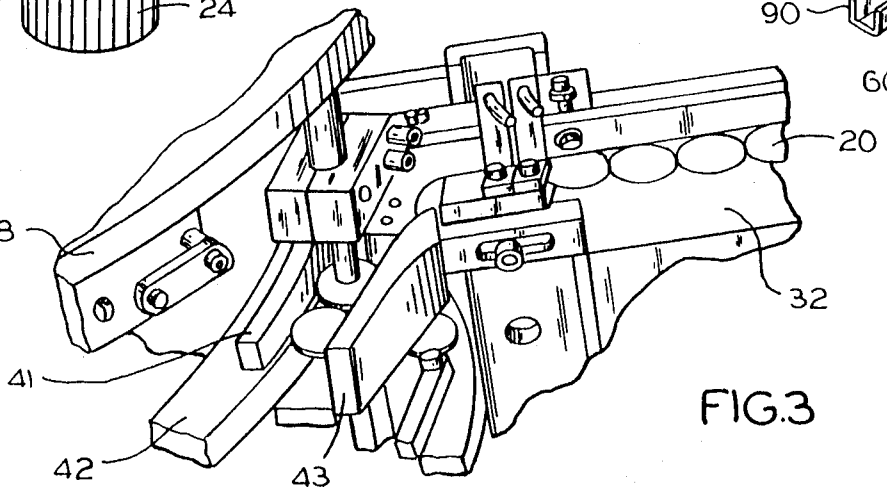
FIG. 3 is a perspective view of a portion of the invention showing the open flip-top caps leaving the feeder chute and loading onto the wheel transport.

The flip-top caps are removed from the mold while they are still in the open position (FIG. 1). Then, they are dumped in bulk into the hopper 29 of a conventional vibrational feeder 30 (FIG. 2) which orients them so that they are upright as shown in FIG. 1. While in such a uniform orientation, they are fed through a delivery or feeder chute 32, where they move in single file toward a work station including flip-top cap closure head 34. As shown in FIG. 3, while in the chute 32, the flip-top 20 may be held in single-file orientation, with the cover at an approximately 180 degree angle relative to the barrel, and with a tolerance of ±20 degrees. The caps 20 approach the work station sideways, so that the cover and barrel of each cap reach the work station simultaneously.

The closure head 34 has two coaxial turntables 38, 40. A wheel 42 is coaxially positioned between the turntables 38, 40, all of which are mounted to rotate as a unit about the hub 44. The wheel 42 (FIG. 5) has a series of openings or pockets 46 formed at equal intervals around the periphery thereof. Each of these pockets is adapted to receive one flip-top cap as it passes out the end of discharge chute 32, and then to carry that cap around a predetermined path. For example, one cap 48 is shown in FIG. 5 as having been received by pocket 46.

To insure that the open caps received from the cap feeder chute 32 are properly seated within pockets 46, a pair of guide rails 41, 43 (FIG. 3) are fixed in position where the feeder chute delivers open caps to the rotating wheel 42. Rail 41 is curved to conform to the arcuate path of a cap retained on wheel 42. The rail 41 is positioned on the radially inner side of a pocket 46, and extends above it a distance approximately equal to the height of the caps to be closed. Rail 43 is parallel to rail 41 on the radially outer side of a pocket 46, but spaced apart from rail 4 by a distance approximately equal to the diameter of the caps to be closed. As open caps are forced by gravity and by the following caps off of the feeder chute one at a time toward the wheel transport 42, the guide rails restrict further movement of the caps in a radial direction and direct the caps into the pockets 46.

Figure 5:
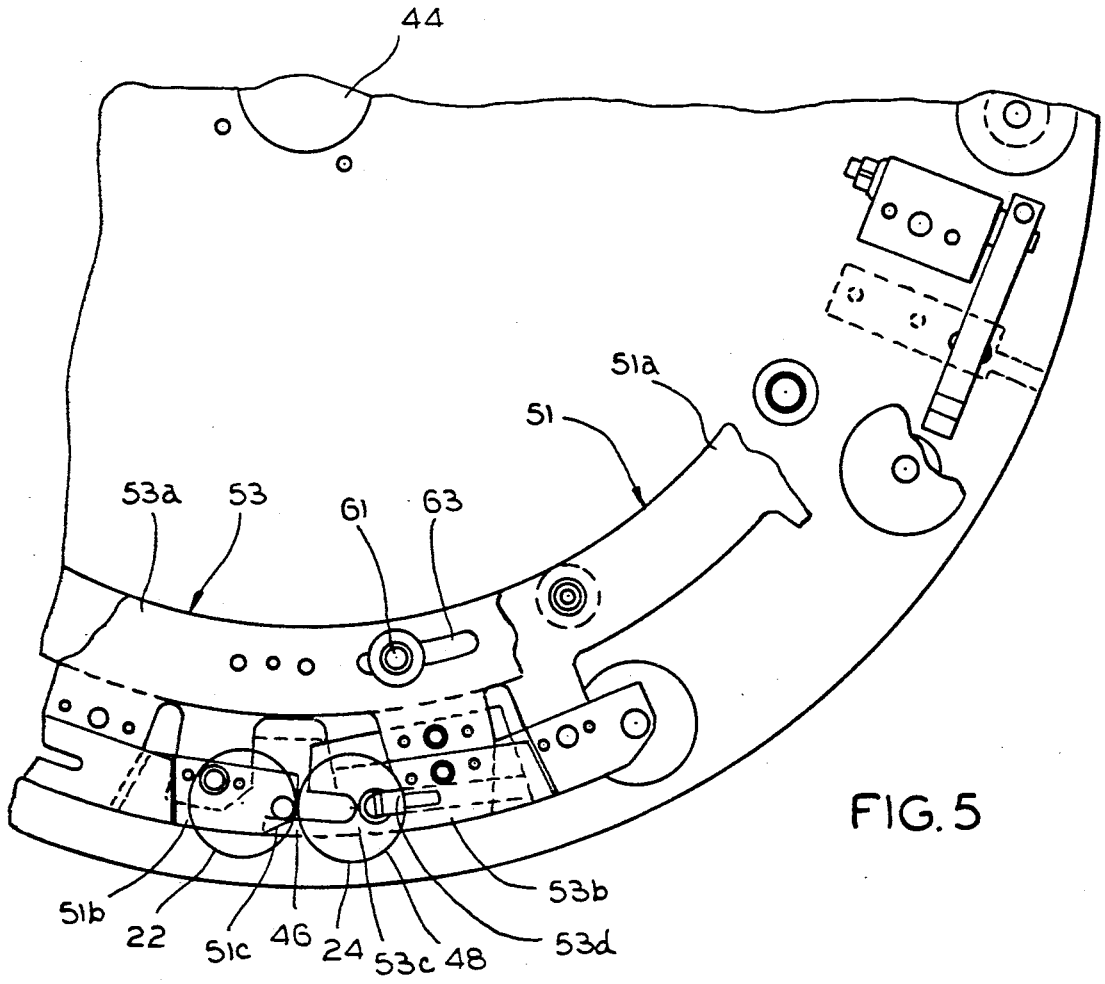
FIG. 5 is a partial plan view partially in section of the wheel transport of the invention.

The preferred wheel 42 includes a pair of coaxially aligned dials 51, 53 (FIG. 5). The two dials cooperate to receive and hold caps fed from the feeder chute 32. First dial 51 and second dial 53 each have circular rings 51*a*, 53*a*, respectively, which overlap. Ring 51*a* lies closer to first turntable 40 than to turntable 38, while ring 53*a* lies closer to turntable 38. The two dials have, for each pocket 46, ledges 51*b*, 53*b* extending radially from rings 51*a*, 53*a*, respectively. Ledge 53*b* has a lower step 53*c* upon which the bottom of cap barrel 24 may rest. The side of cap barrel 24 bears against ledge wall 53*d*. Ledge 51*b* is positioned above step 53*c* and opposite ledge wall 53*d*. The leading edge 51*c* of ledge 51*b* bears on the diametrically opposite side of cap barrel 24 from ledge wall 53*d*. When the caps are in the open position, cap covers 22 lie above ledges 51*b*. The area between leading edge 51*c* and ledge wall 53*d* and above step 53*c* is referred to herein as a pocket 46.

The size of the pocket can be adjusted for caps of various heights and diameters. To adjust for height, the wheel 42 is raised or lowered relative to turntable 38 by adjusting the appropriate screws (not shown) which attach the wheel to the center hub 44. To adjust for diameter, bolt 61 is loosened and dial 53 is rotated a distance not exceeding the length of slot 63, while dial 51 remains fixed. This changes the separation between leading edge 51*c* and ledge wall 53*d*.

Figure 17:
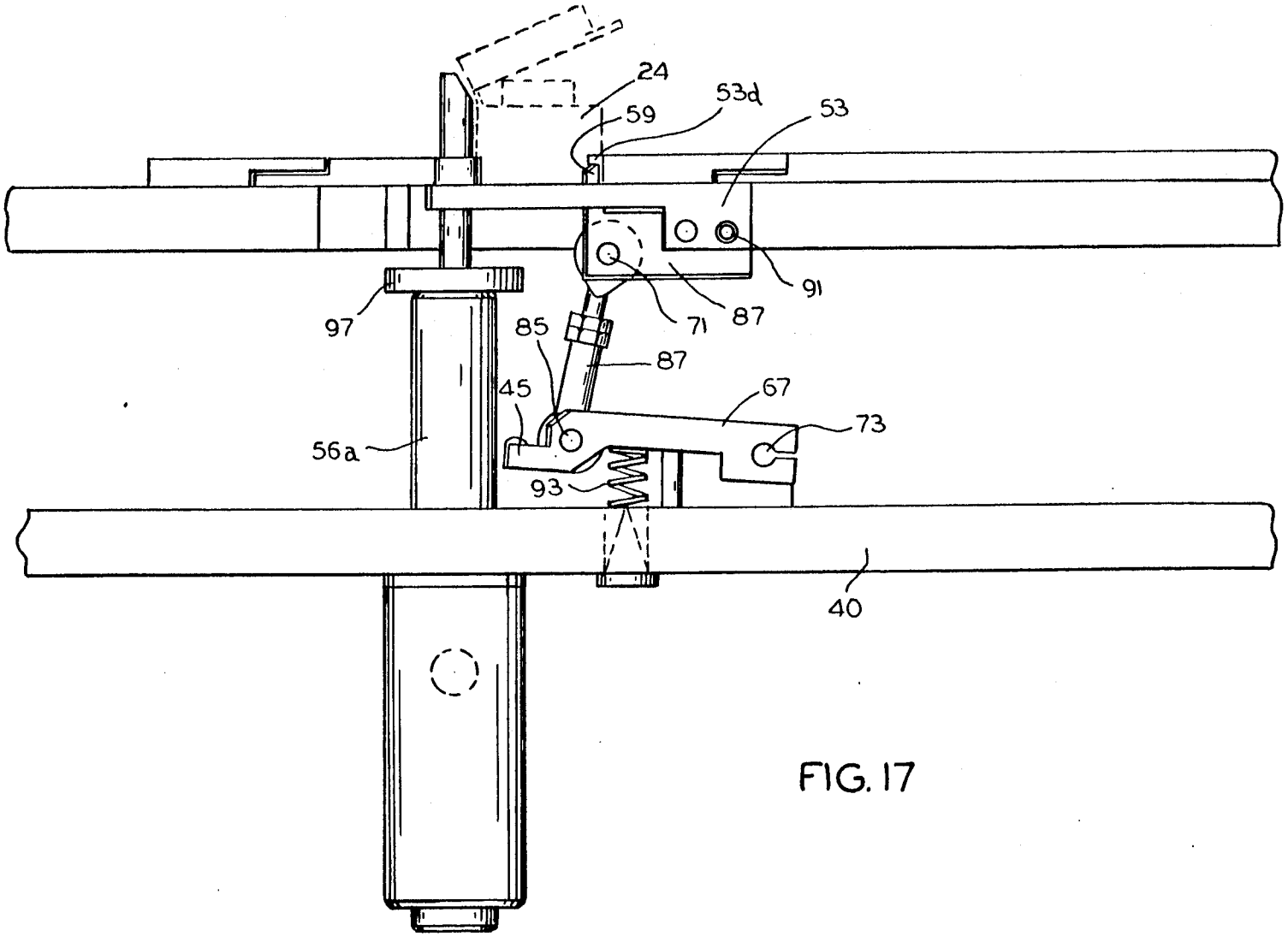
FIG. 17 is a perspective view of a cap gripping assembly on the wheel transport of the invention.

Once the pocket size has been set for the caps to be closed, the wheel transport 42 is ready to receive the caps and hold them in position for closing. A cap gripping assembly 57 is shown in FIG. 17. A lever arm 67 is connected at one end by pivot pin 73 to turntable 40. At its other end, lever arm 67 is connected via pivot pin 85 to one end of connecting arm 87. The opposite end of connecting arm 87 is connected via pivot pin 71 to gripper 87. Gripper 87 has a finger end 89 which extends into pocket 46 and is pivotally connected by pin 91 to dial 53. Finger end 89 extends generally parallel to, but spaced apart from ledge wall 53*d*.

Lever arm 67 is further connected to turntable 40 by spring 93 which bears vertically upon lever arm 67. The end 95 of lever arm 67 adjacent pivot pin 85 is hooked for intermittent engagement with an actuator 56, as described subsequently.

To activate the cap gripping assembly and close the caps, one of several cap closing mechanisms can be used. The first embodiment of the closing mechanism includes a plurality of first or lower and second or upper actuators mounted on each of the turntables 40, 38, respectively, at positions over and under the pockets 46 of the wheel. These actuators operate as described in U.S. Pat. No. 4,847,988, which is incorporated herein by reference. Two such actuators are numbered 54, 56 (FIG. 2). The actuators advance and retract or move up and down (directions C, D) perpendicularly with respect to the surfaces of the turntables. If the closure head were positioned along a horizontal hub or axis, for example, the actuators would be moving from side to side, or left and right, in a horizontal direction. Therefore, the terms "upper" and "lower" should be construed broadly enough to also cover "left" and "right."

An upper cam 58 and a lower cam 60 extend substantially around each of the turntables 38, 40, respectively, to selectively move the actuators. The cams are fixed relative to the rotatable turntables and wheel. Each upper actuator has a corresponding cam follower extending toward the cam 58 and to raise or lower the actuator. Suitable springs (not shown) may be supplied to urge the actuator to follow the cam. For example, actuator 62 has a cam follower 64 which is shown as extending perpendicularly from actuator 62 toward cam 58 and riding on a high surface 66 of the cam 58 in order to retract or raise the actuator 62 away from the wheel 42 and caps contained in it. At other positions in the rotation of turntable 38, the cam follower 64 riding on cam 58 causes the actuator 62 to advance or lower toward wheel 42 and caps contained in it.

The actuators carried by the first or lower turntable 40 also have Cam followers 126 (FIG. 6) and operate in the same manner, being raised or lowered by the cam 60 as the turntable rotates. Desirably, the actuators of the first or lower turntable are chamfered at the ends contacting the cover 22 (FIGS. 13, 14) to provide longer and smoother contact between the actuators and the cover. This is because the caps should be closed soon after molding and while they are still warm to avoid breakage, and at a time while the plastic material is often still soft. Breakage of the hinge is avoided with a gentle and gradual closing motion. The chamfer angle may vary according to the size of the cover, but a 22 degree angle from the vertical has been found generally satisfactory.

Figure 13:
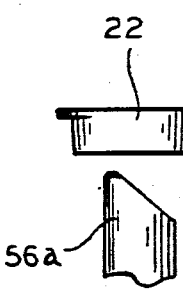
FIGS. 13–15 are three stop motion views showing a flip-top cap being closed.
Figure 14:
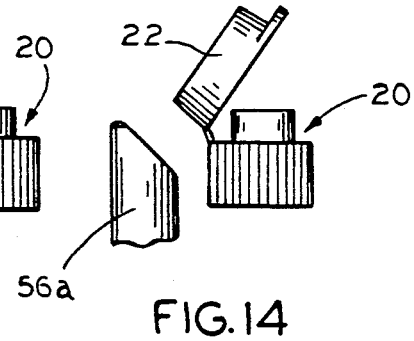
Figure 15:
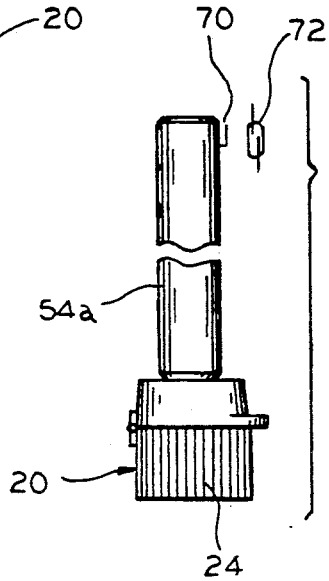

The operation of the actuators is illustrated in the stop motion of FIGS. 13–15. The wheel 42 and turntables 38, 40 rotate as a unit, carrying the actuators 54, 56 past the cams 58, 60. Each pocket 46 on the wheel 42 picks up one cap 48 as it passes the end of chute 32. An actuator 56*a* (FIGS. 13, 14) located on first or lower turntable 40 is positioned beneath the cover 22 of each cap 20 while it is in a wheel pocket 46. Another actuator 54*a* located on the second or upper turntable 38 is positioned over each barrel 24 (FIG. 15). At the loading position where the cap is received from chute 32, cam 60 holds the first or lower actuator 56*a* in a lowered position (FIG. 13), so as not to interfere with the pick up of cap 20 from the chute 32. When first or lower actuator 56*a* is in its lowered position, its collar 97 (FIG. 17) engages hooked end 95 of lever arm 67, biasing spring 93 and lowering finger end 89 below step 53*c*. As the turntables 38, 40 and wheel 42 turn relative to the cams, the lower cam 60 moves the first or lower actuator 56*a* upwardly, thereby releasing spring 93 from lever arm 67. Simultaneously, finger end 89 raises to engage and bear firmly against the inside surface of cap barrel 24 in the pocket 46. The finger end 89 pushes the cap barrel against ledge wall 53*d* and continuously grips it with pliers-like action. This action resists not only lateral displacement of the cap (i.e., a sideways movement out of the pocket), but also resists vertical displacement of the cap (i.e., the cap cannot be pulled upwardly out of the pocket). The first or lower actuator 56*a* continues through aperture 51*d* in ledge 51*b* to swing or raise the flip-top cover 22 to an over-center, preclosed position. Next, the upper cam 58 permits second or upper actuator 54*a* (FIG. 15) to move down over the upstanding cover 22. This action by the second or upper actuator 54*a* snaps the cover 22 of the flip-top into a mostly closed position. A sectional cam powered by an air piston firmly closes the cover, as described in U.S. Pat. No. 4,847,988.

Figure 4:
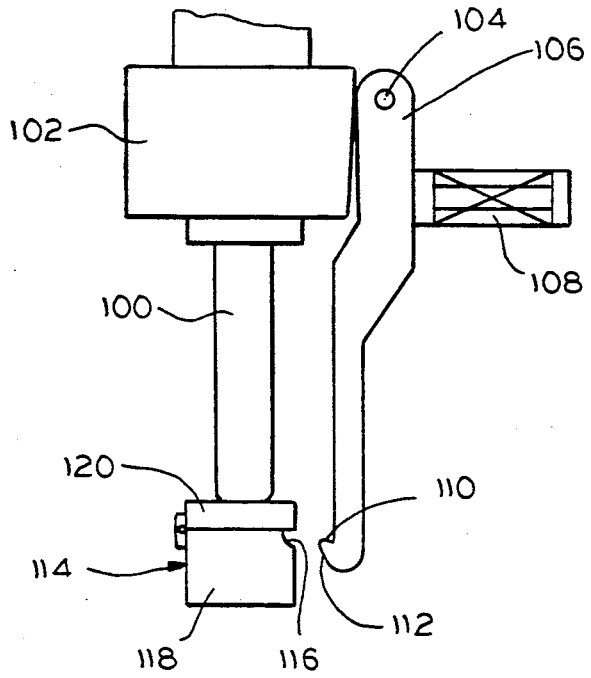
FIG. 4 is an elevation view of a second embodiment of a cap closing mechanism closing a cap.
Figure 16:
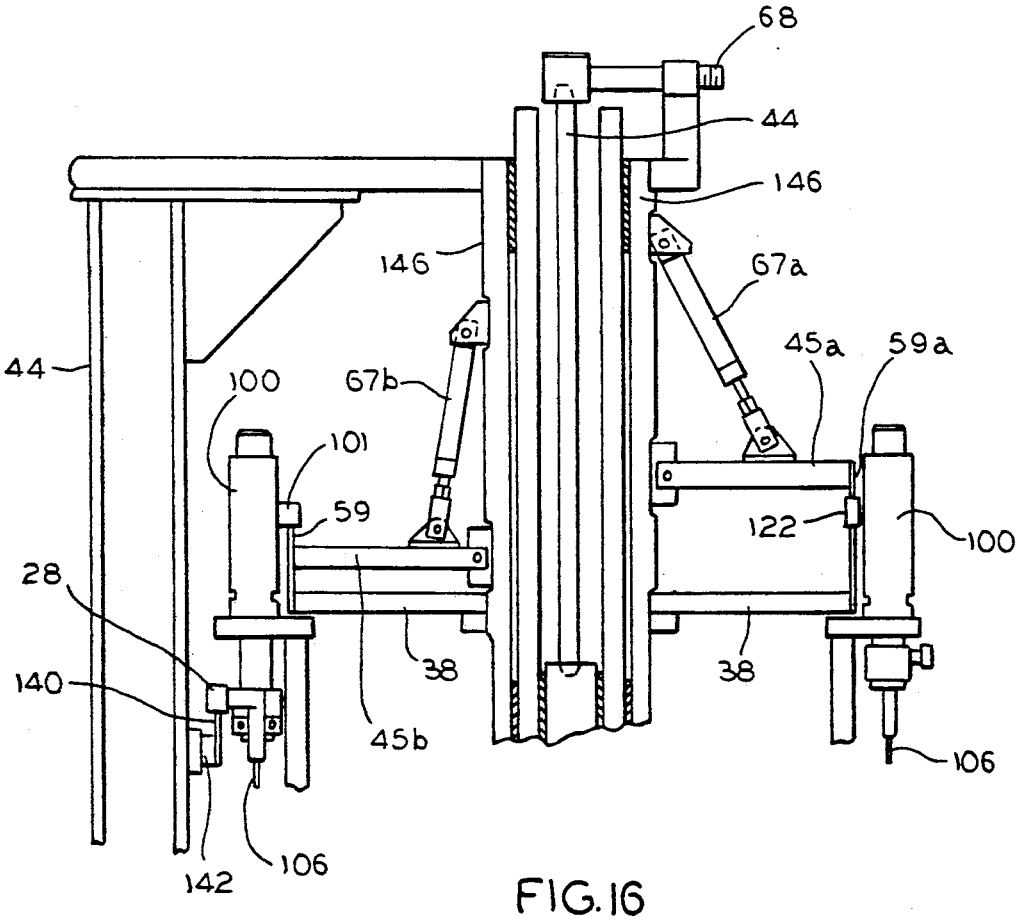
FIG. 16 is a cross sectional view of the upper portion of the closure head of FIG. 2 taken along line 16–16, with one of the air cylinders shown revolved from its true position.

A second embodiment of the cap closing mechanism is similar to the first embodiment but goes further than merely closing the covers on the caps. It also determines whether the caps have been properly manufactured so that the covers can be reopened and reclosed with the desired amount of force. The testing apparatus is shown in FIGS. 2, 4, and 16. Four air cylinders and pistons 67*a*, 67*b*, 67*c*, and 67*d* (hereafter referred to as simply "air cylinders") are supported by brackets 146 over turntable 38 and connected to corresponding sectional cams 59*a*, 59*b*, 59*c* and 59*d*, located in a testing area above and along cam 58. These sectional cams, in turn, are slidably mounted to hub 44 by arms 45*a*, 45*b*, 45*c*, and 45*d*. A conventional air source (not shown) provides air pressure to the air cylinders via hose 68 through air pressure regulators 69*a*, 69*b*, 69*c*, and 69*d*.

When a selected air pressure is applied to or withdrawn from the air cylinders, the air pistons will move the attached sectional cams up or down with that same force or pressure. A cam follower 122 (FIG. 16) riding along cam 58 and below sectional cams 59*a* and 59*c* will transmit the selected downward force through the corresponding actuator to the cap cover 22 below it, closing it. A cam follower 101 riding along cam 58 will roll over the top of sectional cams 59*b* and 59*d* when it reaches them, and that cam follower will transmit the selected upward force through the corresponding actuator to the cap cover 22 below it, opening it as described in more detail hereafter.

The amount of air pressure is adjustable and, hence, the closing force applied to the piston is likewise adjustable, depending upon the opening and closing resistance of the caps and upon the choice of the operator of the machine.

When the cover snaps shut at the most advanced or lower-most position of the second or upper actuator 54*a*, a sensor 70, 72 (FIG. 15) completes a circuit to indicate a successful closing of the cap.

If the flip-top cap does not completely close, the partially open cover prevents the upper actuator 54*a* from traveling far enough to trip the sensor 70, 72. When this happens and sensor 70, 72 does not give a signal, a circuit is completed to indicate an improperly closed cap. The position of this cap on the wheel is placed in the memory of the sensor, so that ultimately along the path of the wheel the defective cap is discharged from the machine as a reject. In FIG. 15, the sensor is shown as a magnet 70 mounted on upper actuator 54*a* and a reed contact 72 positioned adjacent the end of actuator 54*a* in its most advanced or lowermost position, which indicates a properly closed cover and an acceptable product. Alternative forms of sensors, such as a combination photodiode and photocell (not shown), could also be used.

As shown in FIG. 4, each actuator 100 located on the second or closing turntable 38 has a block portion 102 which is connected at pin 104 to a pivotally moveable cap opener finger 106 extending generally parallel to the actuator. The pivot pin 104 permits arcuate rotation of finger 106, but rotation is limited by a resilient member 108, such as a spring, which is also attached to block 102. The member 108 bears against finger 106 so that finger 106 is always urged toward a parallel position with the actuator. The finger 106 has a hook 110 at the end distant from pin 104. The innermost surface 112 of hook 110 is angled. The hook 110 permits the finger 106 to engage a cap 114 in a depression 116 customarily molded in barrel 118 and under cover 120.

Caps of different sizes are accommodated by resilient member 108 and angled surface 112. When cam 58 causes finger 106 to move downwardly with actuator 100 toward cap 114, the angled surface 112 will eventually contact cover 120. The downward slide of angled surface 112 along cover 120 will continue until hook 110 reaches depression 116. At that point, resilient member 108 will urge hook 110 into the depression 116, thereby engaging the finger 106 and cover 120. As the upper turntable 38 rotates, actuator 100 is urged upwardly by cam 58, causing finger 106 to pull upwardly on cover 120 and open it. The barrel 24 remains locked down within the cap gripping assembly 57 and pocket 46.

Figures 6, 7, 8, 9:
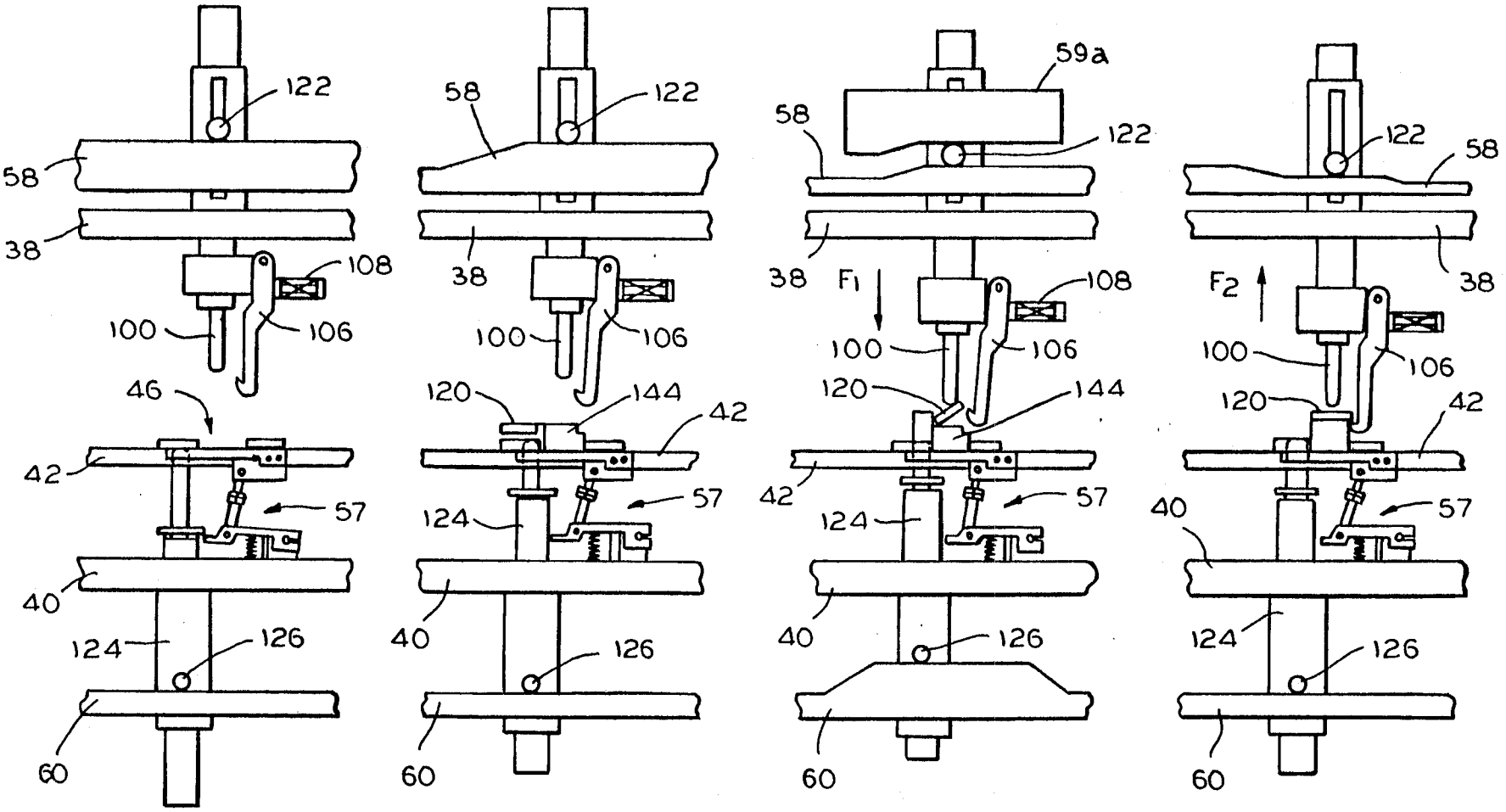
FIGS. 6–9 are four stop motion views showing the position of the actuators and cap opener finger before and during the closing of a flip-top cap, as a cap is delivered to the wheel with its cover in an open condition and then closed over the barrel.

A testing sequence is shown in FIGS. 6–12. FIG. 6 shows: sections of the upper and lower turntables 38, 40; upper and lower cams 58, 60; an upper actuator 100 and its cam follower 122; associated finger 106 and resilient member 108; a section of wheel 42; and a lower actuator 124 and its associated cam follower 126. The pocket 46 of wheel 42 is empty of caps. In FIG. 7, an open cap 114 has been captured and held down in pocket 46 by cap gripping assembly 57, and lower actuator 124 is moving upwardly to close the cap cover 120.

In FIG. 8, lower actuator 124 has pushed cover 120 over past the vertical into a preclosed position, and upper actuator 100 is descending with a first force $F_1$, which is the maximum allowable closing force.

The manner in which force $F_1$ is applied to cover 120 is best shown in FIGS. 8, 16. As described earlier, actuators 100 on the upper turntable 38 each have a cam follower 122 riding along upper cam 58. A first sectional closing cam 59*a* is mounted parallel to the path of wheel 42 along arm 45*a* which extends radially outwardly from the hub 44 toward the actuator. The first sectional closing cam 59*a* is positioned the appropriate distance from the hub 44 so that it can engage cam follower 122 without obstructing the revolving actuators. The arm 45*a* can slide vertically up or down in response to the force applied through air cylinder 67*a*. Thus, when an open cap 114 and its corresponding actuator 100 reach arm 45*a* along the path taken by rotating wheel 42, air cylinder 67*a* exerts a downward push or force $F_1$ on arm 45*a* (FIG. 8), which in turn exerts that same force through first sectional closing cam 59*a*, cam follower 122, and actuator 100 to close cap cover 120.

As described previously, if the cap does not close with that prescribed force, a sensor notes in memory the position of that cap so that it can ultimately be rejected.

In FIG. 9, lower actuator 124 has retracted, and finger 106 has lodged under cover 120, as previously described. Upper actuator 100 and finger 106 are now ready to pull upwardly on cover 120 with a force $F_2$, as shown. $F_2$ may be the maximum allowable opening force.

The manner in which force $F_2$ is applied to cover 120 is similar, but opposite to, the manner in which force $F_1$ is applied. Again with reference to FIG. 16, a first sectional opening cam 59*b* is shown mounted parallel to the path of wheel 42 along arm 45*b*, which extends radially outwardly from the hub 44 toward the actuators. The first sectional opening cam 59*b* is positioned the appropriate distance from the hub so that it can engage cam follower 101 without obstructing the revolving actuators. Arm 45*b* can slide vertically in response to the force applied through air cylinder 67*b*. Thus, when a closed cap 114 and its corresponding actuator 100 reach arm 45*b* along the path taken by rotating wheel 42, air cylinder 67*b* exerts an upward pull or force $F_2$ on arm 45*b*, which in turn exerts that same force through first sectional opening cam 59*b*, cam follower 101, actuator 100, and finger 106 to lift cap cover 120 upwardly and thereby open cap 14. If the cover fails to open at this point, a sensor notes the position of this cap within the wheel for ultimate rejection, as described hereafter.

Figure 11:
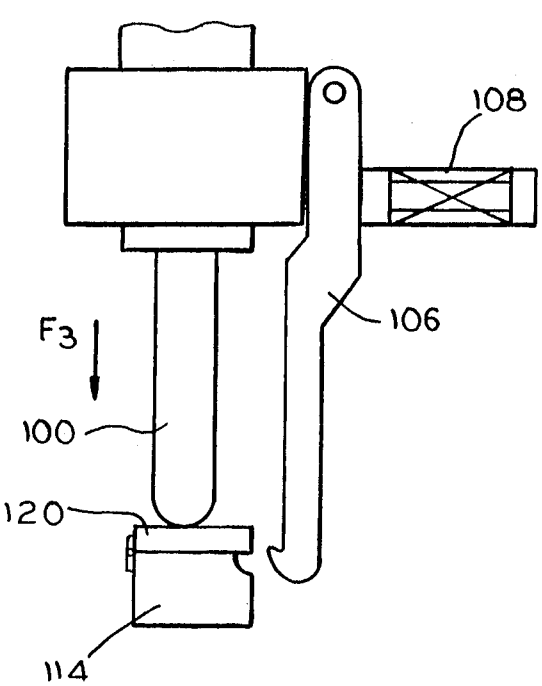
Figure 10:
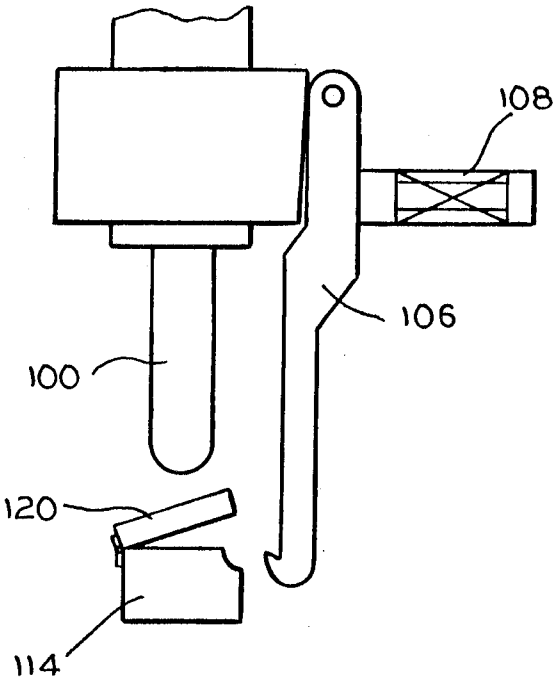

FIG. 10 shows the next step in the sequence in simpler form. Although the turntables, cams, and wheel are not shown, the cap is still retained in the same position within the machine as shown in FIGS. 7–9. At the stage in the testing sequence shown in FIG. 10, the cap 114 has properly opened following application of force $F_2$. In FIG. 11, upper actuator 100 has descended with a force $F_3$ and closed cover 120 once again. $F_3$ may be any force sufficient to close the cover. The force $F_3$ has been applied to cover 120 in the same manner as force $F_1$, but from an air cylinder 67*c* and through second sectional closing cam 59*c* (FIG. 2). Second sectional closing cam 59*c* is mounted on an arm 45*c* spaced angularly from arm 45*b*.

Figure 12:
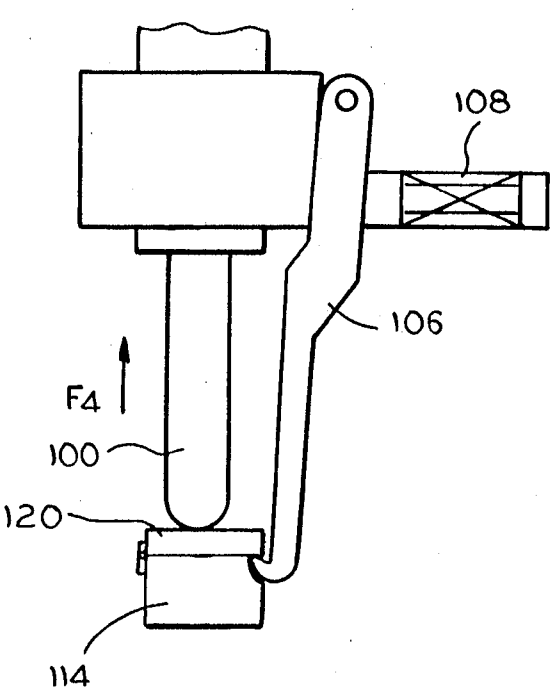
FIGS. 10–12 are three stop motion views which continue from FIG. 9, as a closed cap is tested with the cap opener finger by reopening, reclosing, and finally attempting to reopen the cover.

In FIG. 12, actuator 100 has descended toward cap 114 and finger 106 has again lodged under cover 120. The finger and upper actuator are applying a force $F_4$ upwardly against the cover 120. $F_4$ is close to, but below, the minimum allowable opening force. This force $F_4$ is applied to cover 120 in the same manner as force $F_2$, but from an air cylinder 67*d* and through second sectional opening cam 59*d* (FIG. 2). Second sectional opening cam 59*d* is mounted on an arm 45*d* spaced angularly from arm 45*c*. *If cover 120 opens with force $F_4$*, a sensor notes the position of this cap within the wheel for ultimate rejection.

If cover 120 does not open with force $F_4$, the finger 106 is still lodged under cover 120 and must be dislodged before the cap can be further processed by the machine. This is accomplished with a dislodging sectional cam 140, best shown in FIG. 16. Dislodging cam 140 is mounted on a radially extending arm 142 fixed to a vertical support tube 144. The support tube 144 is L-shaped, with the horizontal leg fixed to hub 44 and the vertical leg positioned outside the path of the wheel, so that arm 142 extends radially inwardly toward the hub and just far enough to be able to engage knob 128. Knob 128 extends radially outwardly from finger 106 on each upper actuator 100. When the revolving actuator 100 and finger 106 reach dislodging cam 140, knob 128 is engaged and urged upwardly by cam 140, which pivots finger 106 away from cover 120. A similar dislodging ca (not shown) can be used to pivot finger 106 away from cover 120 when the cap is first closed, as discussed in connection with FIG. 8.

Figure 18:
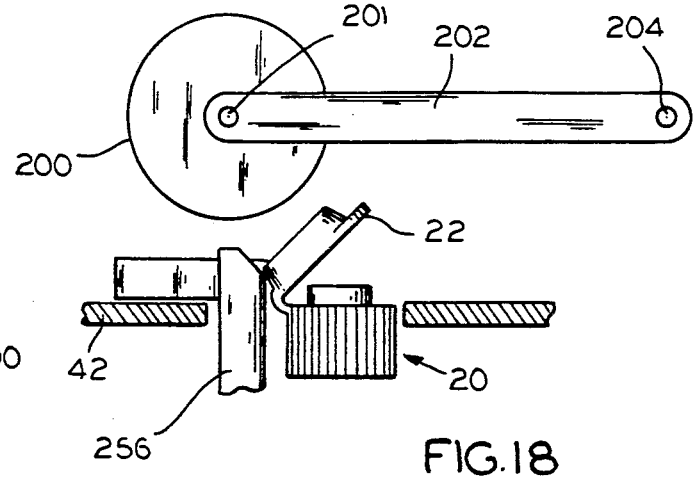
FIG. 18 schematically illustrates a third embodiment of a cap closing mechanism for the invention.
Figure 19:
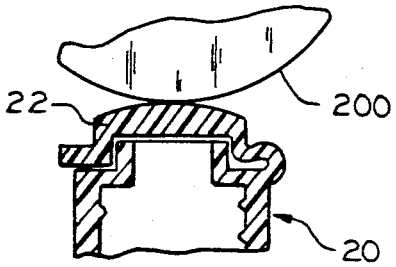
FIG. 19 is a cross sectional view of a closed cap showing a closing wheel of the third embodiment poised over a cap cover with a convex upper surface.
Figure 20:
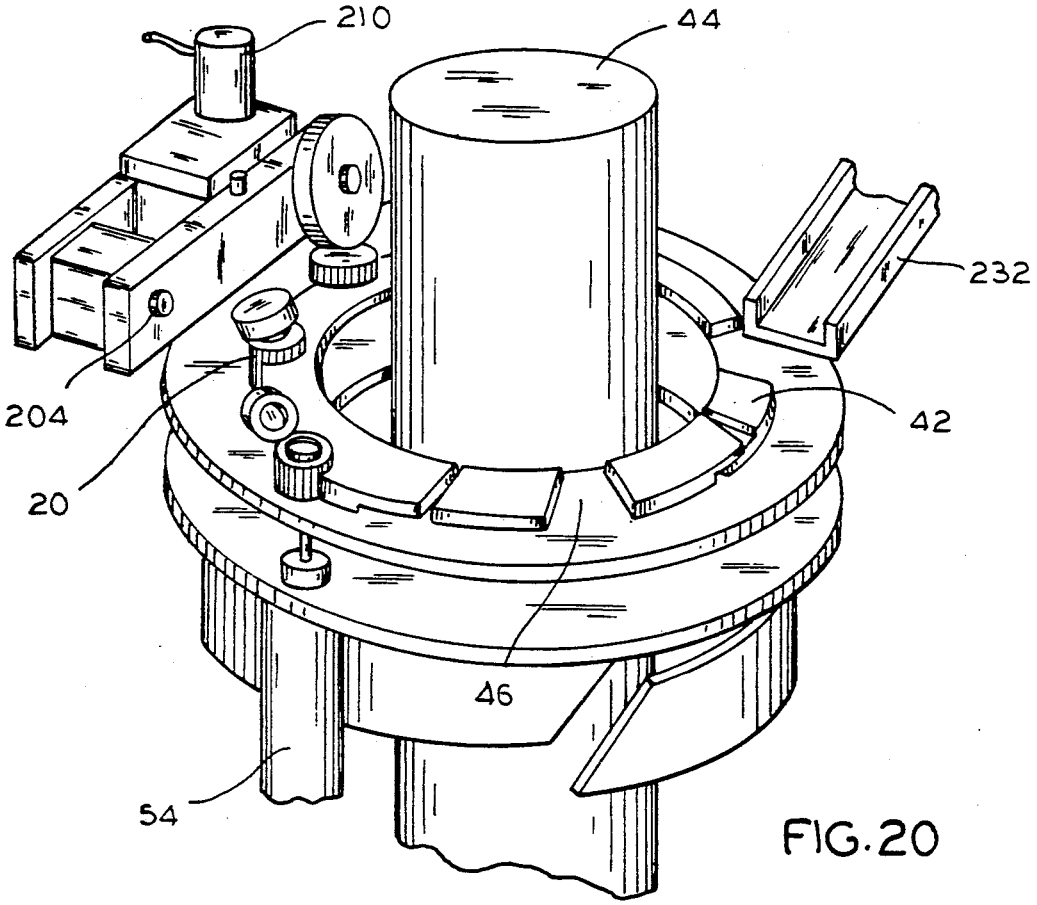
FIG. 20 is a simplified perspective view of the invention with the third embodiment of a closing mechanism and a single lower actuator.

A third embodiment of a closing mechanism is seen in FIGS. 18, 19 and 20. This embodiment is particularly well adapted to closing caps with covers having a convex upper surface, best seen in FIG. 19.

This embodiment does not have the upper turntable 38 or any of the actuators or cap opener fingers associated with the upper turntable. However, the remainder of the machine remains substantially the same.

Instead of upper actuators, a rolling wheel 200 rolls over and finally closes the cover 22 of cap 20 after cover 22 has been moved into an over-center, preclosed position by the advance of second or lower actuator 256. The wheel 200 is mounted on an axle 201 over the cap 20, cover 22, and actuator 256, and on the end of a lever 202 which swings around pivot point 204. Over the lever is an air cylinder and piston 210 for maintaining the desired pressure of the lever and, hence, the wheel, against the caps.

The operation of this embodiment is seen in FIG. 20. The unclosed caps move down chute 232 and are deposited, one cap at a time into the pockets 46 of wheel 42. The cap gripping assemblies 57 (as previously described) retain the caps. As the caps are carried by the wheel 42, cam 60 advances or raises the first or lower actuator 54 to move cover 22 into an over-center or preclosed position, as shown in FIG. 19.

After the actuator 54 is lowered, the wheel 200 rolls over cover 22 and finally closes it onto the threaded barrel, as shown in FIG. 20. The upward force of the cap covers 22 against the wheel 200 is exceeded by the opposing force exerted by the air cylinder 210 against the lever 202 and wheel 200, so as to maintain a smooth, firm closing process. The air pressure exerted through the air cylinder is adjustable, so the cap closing force is likewise adjustable according to the requirements of the particular caps to be closed.

Once closed by a closing mechanism, the cap is now ready to leave the wheel transport 42. Before a cap can be discharged, it must be released from the cap gripping assembly 57. Lower cam 60 guides the first or lower actuator 54 down at this point along the wheel path, causing collar 97 to once again engage hooked end 95 of lever arm 67, thereby lowering finger end 89 away from the closed cap. The cap is now loosely within pocket 46.

At this point, an improperly closed cap can be removed from the wheel and discarded through reject chute 90 extending from wheel transport, as by blowing air or by any suitable means.

The same process can be followed for completely closed caps which have passed the force tests. An air jet (not shown) can be positioned just before the eject chute 80 (FIG. 2), which receives the caps which pass the force tests. Sensors similar to those described above can be located on the eject chute, or elsewhere along the feeder chute 32, or around the wheel transport 42, to detect open covers or to count the passing number of caps.

It is highly unlikely that a partially open or defective cap will be discharged into the chute with fully closed and tested caps, since the caps are individually tested and inspected. The number of caps closed by the invention ranges from 150–300 caps per minute, depending on the cap size. Importantly, 100% of the caps which survive the testing process applied by the invention are free of opening and closing defects. That is, they will open and close with the desired amount of force.

Figure 22:
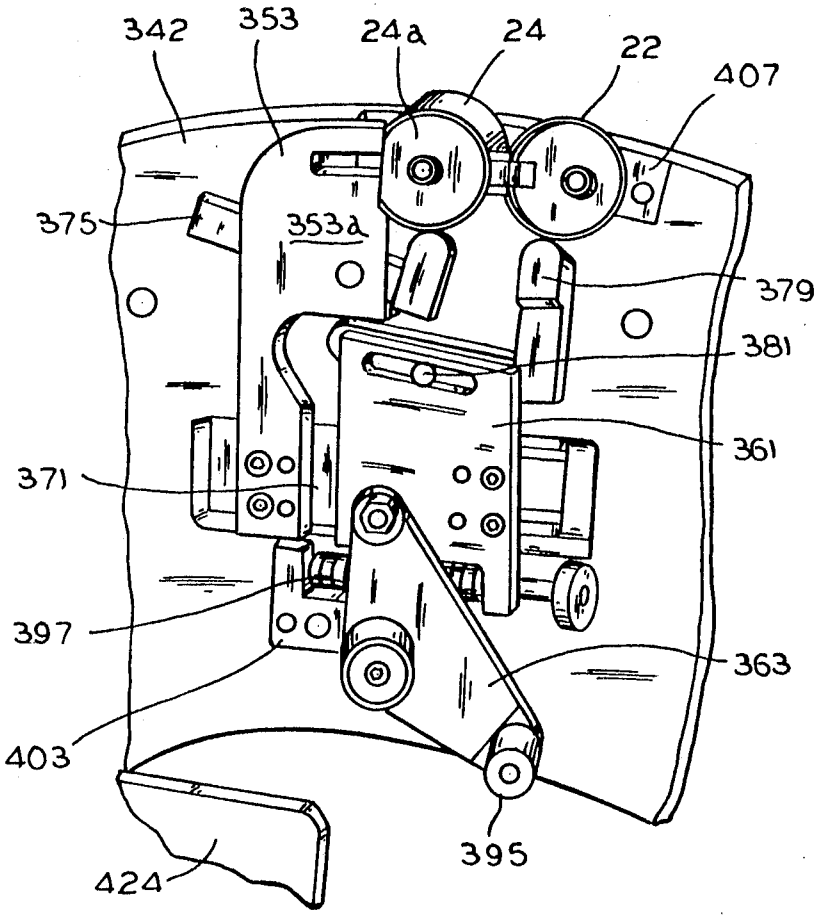
FIG. 22 is a perspective view of the second embodiment of the cap gripping assembly after it has received a cap.
Figure 21:
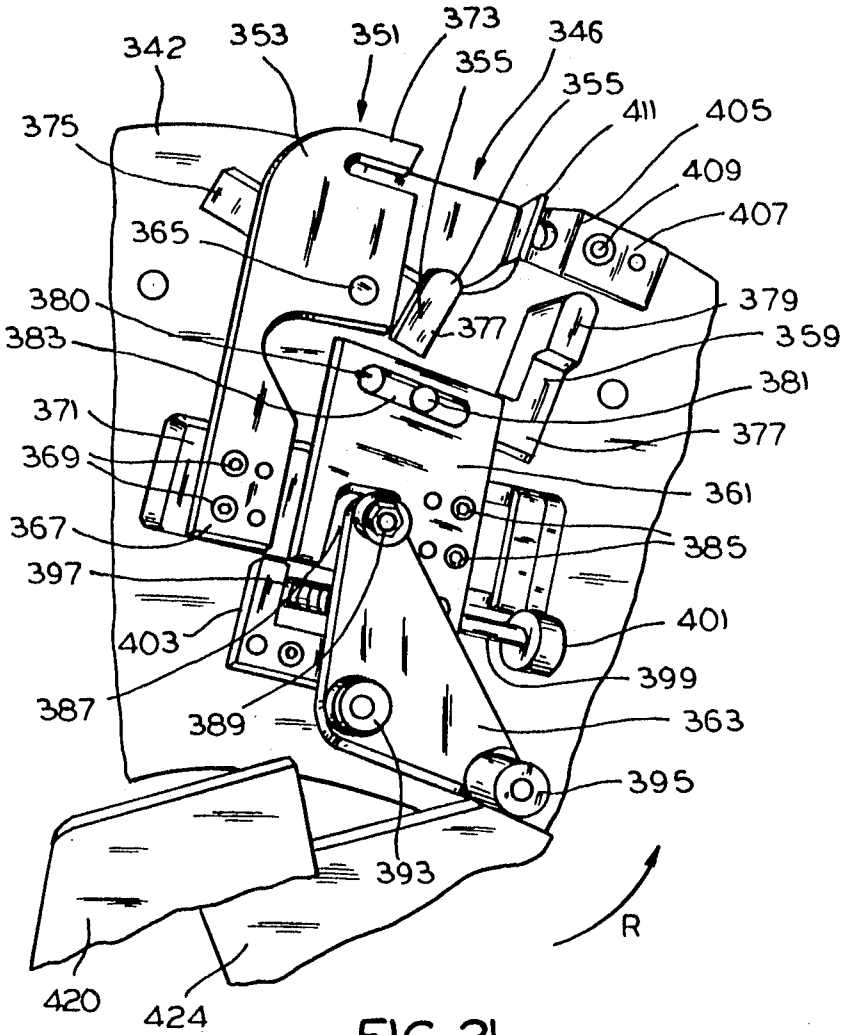
FIG. 21 is a perspective view of a second embodiment of an empty cap gripping assembly on the wheel transport of the invention.

The inventive machine can also use a different wheel design. As shown in FIGS. 21–22, wheel 342 is a single flat disc which includes a plurality of openings 346 along its periphery. Surrounding each opening 346 is a cap gripping assembly 351. The cap gripping assembly 351 includes a cap jaw 353, an L-shaped cap body stop 355, an L-shaped cover stop 359, a slide plate 361, and a cam plate 363. At its proximal end 367, cap jaw 353 is attached by bolts 369 to a slider 371, which in turn is slidingly attached to wheel 342. At its distal end 373, cap jaw 353 is adjacent to pocket 346. Between its proximal and distal ends, cap jaw 353 is pivotally connected at pivot pin 365 to cap body stop 355. Cap body stop 355 lies below cap jaw 353 and above wheel 342. Arm 375 of cap body stop 355 is oriented generally transversely to cap jaw 353, and cap body stop finger 377 is oriented generally parallel to the cap jaw 353 and toward pocket 346.

Cover stop 359 also has an arm 377 and a cover stop finger 379. Cover stop 359 is pivotally fixed to wheel 342 by pivot pin 380. Mounting lug 381 extends upwardly from arm 377 into an elongate mounting aperture 383 in slide plate 361. Cover stop 359 is thus free to slide laterally subject to the movement of lug 381 within aperture 383, and to move pivotally relative to wheel 342.

Slide plate 361 is fixed by bolts 385 to slider 371, which lies below it. Slide plate 361 has a cover 387 at its end opposite mounting aperture 383, through which bolt 389 extends between slider 371 and cam plate 363. Cam plate 363 is generally triangular and is pivotally mounted at its vertex to wheel 342 at pivot pin 393. Cam roller 395 extends upwardly from cam plate 363 at its radially inside corner.

A coil spring 397 is mounted longitudinally along rod 399 and bears against slide plate 361. Rod 399 is fixed to wheel transport 342 at one of its ends by mounting fixture 401, and at its other end by mounting bracket 403. Rod 399 is oriented parallel to the longitudinal dimension of slider 371. Since slide plate 361 is fixed to slider 371, the compression or relaxation of spring 397 against slide plate 361 determines the lateral position of both slider 371 and slide plate 361.

At the side of opening 346 opposite distal end 373 of cap jaw 353 is anvil 405. Anvil 405 includes an end 407 extending parallel to wheel 342 and fixed thereto by bolt 409, and a flange portion 411 extending generally transversely to wheel 342. Flange 411 provides an opposing surface against which cap jaw 353 can push cap barrel 24. Flange 411 is also positioned to underlie and support the hinge of a cap which has been fed into opening 346.

Figure 23:
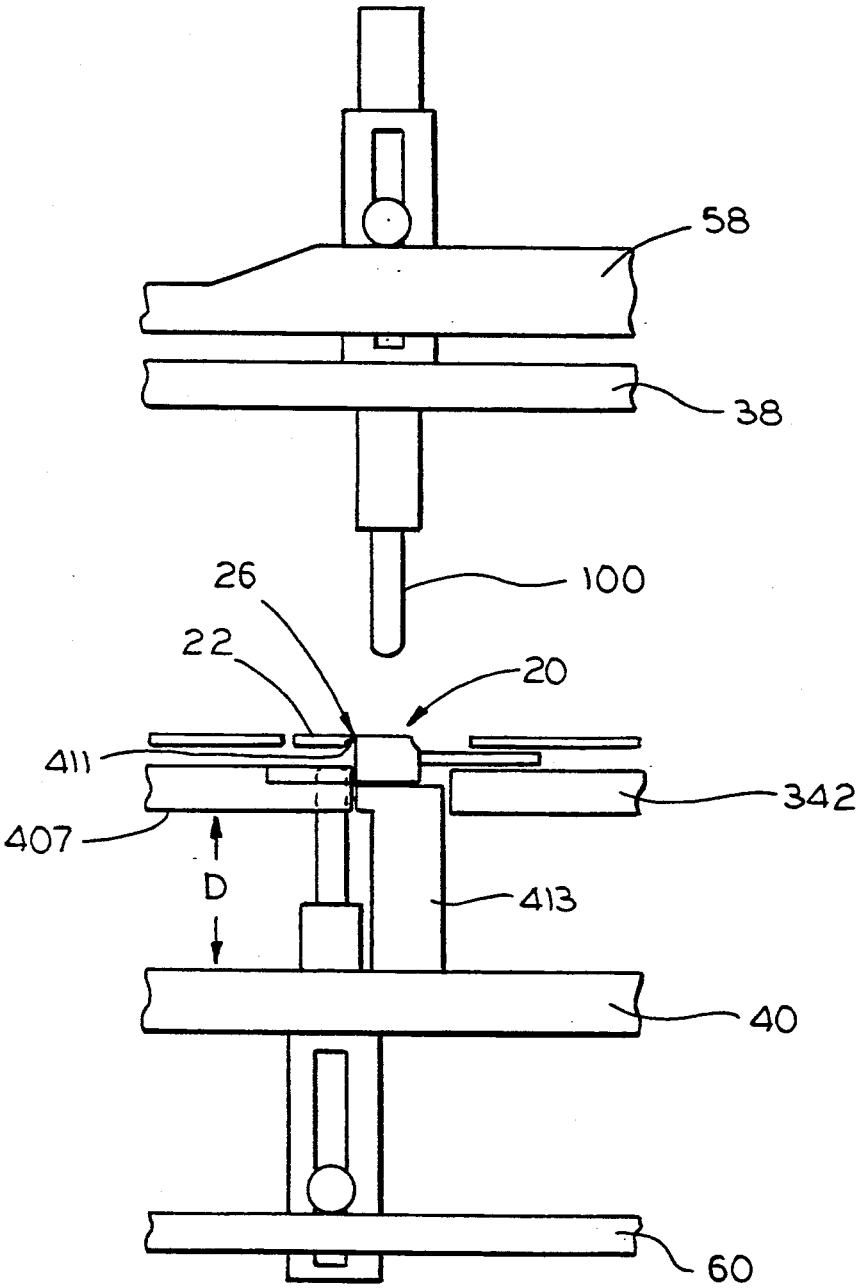
FIG. 23 is an elevation view of a cap clamped within the cap gripping assembly of FIG. 22 and about to be closed by the actuators.

With this embodiment of wheel 342, the invention further includes at least one and preferably a series of adjustable floors or platforms 413 extending from turntable 40 toward wheel 342 beneath each opening 346 (FIG. 23). By adjusting the axial distance D between wheel transport 342 and turntable 40, the floors 413 can be positioned to support caps of various heights so that the top surface 353*a* of cap jaw 353 and the top surface 24*a* of cap barrel 24 are approximately coplanar (FIG. 22). The combination of the cap gripping assembly 351 and the floor 413 create a pocket around opening 346.

The cap gripping assembly is cam controlled. Fixed jaw cam 420, shown only in section, is a plate permanently fixed around hub 44 and positioned so that roller 395 of the cam plate 363 moves in and out of engagement with the radially outside edge 422 of cam 420 at the proper times, as described hereafter. Adjustable jaw cam 424 is another plate which is positioned axially around hub 44, but it is positioned below fixed jaw cam 420. Before the machine is started, adjustable jaw cam 424 is rotated angularly about hub 44 until it is fixed in the desired position, which depends upon the diameter of the caps to be closed. Fixed jaw cam 420 and adjustable jaw cam 424 cooperate with the adjustable jaw assembly as follows.

When a cap closing machine devoid of caps is first activated, the wheel rotates and approaches cap feeding chute 32. Roller 395 engages cam edge 422 (FIG. 21), causing cam plate 363 to pivot in a counter-clockwise direction R about pivot pin 393. This movement compresses coil spring 397 and pushes slider 371 to the left. This, in turn, moves cap jaw 353, cap body stop 355, and cover stop 359 away from pocket 46, leaving it fully open and unobstructed for the feeding of open caps.

For the largest diameter caps, adjustable jaw cam 424 engages the cap gripping assembly only after a cap is received in pocket 346. For smaller diameter caps, adjustable jaw cam engages the jaw assembly before a cap is received in pocket 346. By properly positioning adjustable jaw cam 424 around the hub, the size of the pocket 346 is controlled with the jaw assembly s that it is large enough to easily receive the feeding caps, but not so large that the caps could lose their proper orientation within the pocket 346.

When the next open cap in chute 32 is forced by the caps behind it into open pocket 346, the cap enters the pocket with its barrel 24 on the cap jaw 353 side of the pocket and with the cap hinge 26 overlying flange 411. Adjustable jaw cam 44, like fixed jaw cam 420 before it, engages roller 395 and gradually allows cam plate 363 to pivot clockwise about pivot pin 393, which in turn allows spring 397 to extend and push slider 397 to the right as shown in FIG. 22. This causes cap jaw 353 and cap body stop 355 to be urged toward and clamp upon barrel 24 while cover stop 259 engages cover 22, thereby securing the cap in place. Caps of a large range of diameters are, therefore, accommodated without the need to change cap closing machines or machine components.

The caps are now securely clamped down and in position to be closed by the actuators and tested for proper opening and closing forces, as described previously.

Those who are skilled in the art will readily perceive how to modify the invention. Therefore, the appended claims are to be construed to cover all equivalent structures which fall within the true scope and spirit of the invention.

The invention claimed is:

1. An automatic machine for closing caps having a cover hinged to a hollow barrel, comprising:

means for uniformly orienting said caps and delivering them through a chute toward a work station;

means at said work station for receiving said caps one at a time from said chute, said receiving means clamping said cap barrel to resist lateral and vertical displacement of said cap barrel;

means for transporting said received caps over a predetermined path within said work station;

first actuator means for moving the cover of each cap into a preclosed position as each of said caps are transported over said path;

second actuator means for closing said preclosed caps over said barrels; and tester means associated with said second actuator means for determining whether the covers can be reopened and reclosed with the proper amount of force, wherein said tester means comprise a cap opener finger fixed to said second actuator means and means for applying a predetermined reopening force through said finger onto said cap cover for reopening said cap cover.

2. The machine of claim 1 wherein said tester means also includes a resilient member for urging said cap opening finger toward said cap.

3. The machine of claim 1 wherein said reopening force means includes at least one air powered closing piston and a sectional cam connected thereto, said sectional cam positioned so that said piston can move said sectional cam into contact with the nearest actuator with the predetermined reopening force.

4. An automatic machine for closing flip-top caps having a cover hinged to a hollow barrel, comprising:

means for uniformly orienting said caps and delivering them through a chute toward a work station;

means at said work station for receiving said caps one at a time from said chute, said receiving means clamping said cap barrel to resist lateral and vertical displacement of said cap barrel;

means for transporting said received caps over a predetermined path within said work station;

first actuator means for moving the cover of each cap into a preclosed position as each of said caps are transported over said path;

second actuator means for closing said preclosed caps over said barrels; and a fixed cam attached to said work station for opening said receiving means to accept said caps at a particular point along said predetermined path, and an adjustable cam attached to said work station for closing said receiving means against said caps at a variable point along said predetermined path.

* * * * *